United States Patent [19]

Thacker

[11] Patent Number: 4,826,610

[45] Date of Patent: May 2, 1989

[54] FIRE EXTINGUISHANT

[75] Inventor: Derek A. Thacker, Jurby Airfield, United Kingdom

[73] Assignee: Tag Investments, Inc., Canada

[21] Appl. No.: 3,445

[22] Filed: Jan. 15, 1987

[51] Int. Cl.[4] ..... A62D 1/00; A62C 1/00; A62C 3/00

[52] U.S. Cl. ..... 252/8; 169/46; 169/47; 252/2

[58] Field of Search ..... 252/8, 7, 2, 601, 603; 169/44, 45, 46, 47; 106/226

[56] References Cited

U.S. PATENT DOCUMENTS

| | | | |
|---|---|---|---|
| 1,243,149 | 10/1917 | Ferguson | 252/8 |
| 1,270,393 | 6/1918 | Ferguson | 252/8 |
| 1,270,394 | 6/1918 | Ferguson | 252/8 |
| 1,270,395 | 6/1918 | Ferguson | 252/8 |
| 1,270,396 | 6/1918 | Ferguson | 252/8 |
| 1,270,397 | 6/1918 | Ferguson | 252/8 |
| 1,292,743 | 1/1919 | Ferguson | 252/8 |
| 1,292,744 | 1/1919 | Ferguson | 252/8 |
| 3,859,151 | 1/1975 | Vincent et al. | 252/8 |
| 3,879,297 | 4/1975 | Languille et al. | 252/8 |
| 4,230,808 | 10/1980 | Pietersen | 252/8 |

FOREIGN PATENT DOCUMENTS

| | | | |
|---|---|---|---|
| 0197267 | 11/1984 | Japan | 252/8 |
| 197709 | 6/1971 | U.S.S.R. | 252/8 |
| 1079258 | 3/1984 | U.S.S.R. | 252/8 |
| 691448 | 7/1951 | United Kingdom . | |
| 1370381 | 10/1974 | United Kingdom . | |
| 1603867 | 12/1981 | United Kingdom . | |

OTHER PUBLICATIONS

Research Disclosure #13536, Fire Extinguishers Containing Halogenated Hydrocarbon, Jul. 1975, pp. 45–46.

Halon 1301 as a Fire Fighting Medium on Board SHip, Marine Engineers Review , Aug. 1972, pp. 21–22.

*Primary Examiner*—Howard J. Locker

*Attorney, Agent, or Firm*—Harry M. Weiss

[57] ABSTRACT

A firefighting composition comprises one or more of Halons 11, 12, 113 and 114 together with 1% to 14% by weight of an extinguishant base including a sesquiterpene and one or more essential oils. Solvents and dispersing agents may also be provided.

5 Claims, No Drawings

FIRE EXTINGUISHANT

The present invention relates to fire extinguishant formulations and in particular to those based on trichloromonofluoromethane, $CFCl_3$ hereinafter referred to as Halon 11, or mixtures of Halon 11 with all or any of dichlorodifluoromethane, $CCl_2F_2$, trichlorotrifluoroethane, $CCl_2F—CClF_2$ or dichlorotetrafluoroethane, $CClF_2—CClF_2$ hereinafter referred to as Halons 12, 113 and 114 respectively, for use in fire extinguishers, fire tenders and fire extinguishing systems which may be fixed or portable.

Halons 11, 12, 113 and 114 are nonflammable organic compounds which are less toxic than carbon dioxide. The physical and chemical properties of these compounds make them suitable for use as major components in fire extinguishant formulations. Hitherto it has been found difficult to employ these materials in the extinguishment of fires.

It has been found difficult to propel Halon extinguishants to a fire without the jet or spray being dispersed before reaching the fire, or being so light in droplet weight that a further percentage of the whole is lost in the updraught associated with the fire. This problem is exacerbated by the high pressures used to expel the Halons and the low boiling points of the Halons.

The difficulty is more pronounced if an attempt is made to propel the Halon extinguishants over a relatively long distance for example three metres or more from the container to the seat of the fire in the case of hand held portable extinguishers, or much longer distances when major fire fighting equipment was used.

Up to the present time the main Halon extinguishants in use have been bromochlorodifluoromethane, hereinafter referred to as Halon 1211 and bromotrifluoromethane, hereinafter referred to as Halon 1301, both of which are subject to the limitations mentioned above. In order somewhat to reduce the effects of their low boiling points it has been known to dilute both Halon 1211 and Halon 1301 with Halon 11, Halon 12, or where the law permits, carbon tetrachloride.

The use of Halon 11 or Halon 12 in this manner does not truly demonstrate their qualities as extinguishants, and it does not allow the cooling, or long term inhibiting effects of Halon 11 to be seen.

Re-ignition of a fire has always been a matter of great concern. The true value of water as an extinguishant lies in its cooling effect and prevention of re-ignition. It is a matter of common knowledge that water has limited use as an extinguishant on certain types of fire, but in these cases the need to restrict re-ignition still exists. The boiling point of Halon 11 with or without the admixture of one or more of Halons 12, 113 or 114 and the relative adjustment, dictates the extraction of a certain degree of heat from the fire and its surrounds in order that vaporisation may take place. This cooling action is a positive, if lesser contribution towards the prevention of re-ignition.

The fact that the gas produced on the vaporisation of Halon 11, or the aforementioned Halon mixtures will remain for some considerable time as an inhibiting barrier above the fuel in a contained situation, is the major contribution to the prevention of re-ignition.

Different climates with varying temperature ranges dictate changes in the extinguishant boiling point. This may be achieved by adjusting the construction of the Halon mixture mentioned above.

In order to propel Halon 1211 or Halon 1301 towards a fire as quickly as possible, over-pressurisation may be employed. The means most often used include $CO_2$, $N_2$ or Halon 12. A major disadvantage attaching to this system is the rapid disintegration of the jet and an increase in the percentage of extinguishant lost between container and fire.

The inherent pressures of Halon 1211 and Halon 1301 coupled with over-pressurisation require use of strong containers and present certain problems in that the extinguisher could explode if heated by the fire itself, or by an increase in ambient temperature. These problems are particularly acute in the case of Halon 1301.

It therefore follows that an extinguisher using a vaporising medium operating at the lowest possible pressure and with the highest possible boiling point will offer a greater degree of safety in manufacture, storage and operation. Such a vaporising liquid would also be cheaper to load into extinguishers, requiring less sophisticated machinery and simpler containers.

Consideration may also be given to the ease with which the extinguishant itself can be handled. This applies not only during packing but also to the transportation of bulk extinguishant and the refilling of extinguishers after use.

The characteristics of Halon 1211 and Halon 1301 demand careful transportation, storage and use. Extinguishers employing these Halons frequently need to be sent away for refilling, or in the case of ships at sea, retained empty until the vessel reaches port. In this case extra back-up units must be held, resulting in extra initial expense and a need for extra storage capacity.

Percentages referred to in this specification are by weight unless otherwise indicated.

According to the present invention a fire fighting composition comprises one or more halocarbns selected from the group consisting of: trichlorofluoromethane, dichlorodifluoromethane, trichlorotrifluoroethane, dichlorotetrafluoroethane; and between 1% and 14% of an extinguishant base, the extinguishant base including a sesquiterpene.

The composition of this invention has a sufficiently high specific gravity and viscosity to allow it to be propelled to a fire much more effectively than is possible using previously known Halon compositions. Moreover the composition is easier to handle.

The composition is relatively non-toxic in both the unpyrolysed and pyrolysed forms due to the absence of bromine. It is relatively non-toxic during transportation and packing and may be used safely on live electrical circuits.

The boiling point of compositions in accordance with this invention are such that persons handling the composition do not suffer freeze burn or frostbite.

Preferred compositions include 1% to 14% of the extinguishant base, more preferably 7.5% to 14%, 9% to 10% being specifically preferred. The extinguishant base of preferred compositions include one or more essential oils. The essential oils may constitute 15% to 55% of the extinguishant base. Preferred essential oils may be selected from the group consisting of: limonene, geraniol, oil of cypress, oleum rusci, terpineol, oil of monanda, arbor vitae, milfoil oil, oil of cassia, rectified birch oil, oil of fir, oleum abietis and BQ (trade mark of Field & Co.) The base may include a solvent for the sesquiterpene, for example methacide, HMPT, isopropanol or perchloroethane.

The base may also include a dispersing agent for the essential oils, for example IRIDON (J. Skinner and Co. UK). The ratio by weight of solvent to Iridon may be from 2 to 0.25. The solvent may comprise 2% to 4% of the extinguishant base.

The dispersing agent may comprise from 8% to 12% of the extinguishant base.

Preferred compositions include the surfactant HOMOGENOL 14. (Odanhurst Ltd. UK) From 12 to 22% of HOMOGENOL 14 may be present in the extinguishant base.

Preferred compositions may have a specific gravity of 1.4 to 1.8.

Compositions in accordance with this invention may be used by various methods. They may be projected directly onto a fire by means of a hose, pressurised fire extinguisher or via a pump from an open container.

The composition may be mixed into a supply of water to a hose, for example in a proportion of 5% to 20% by volume for fires involving light spillage of flammable liquids. Fires of a carbonaceous nature may be tackled using a water hose with the induction of 5% to 10% by volume of the composition.

Alternatively breakable containers such as drums or capsules containing the composition may be projected onto a fire. Up to 2 kg of the composition may be held in a single fragible container which may be projected by means of compressed air. Alternatively a continuous supply of small capsules may be fed to the fire by means of a mechanical or compressed air delivery system.

The invention is further described by means of example but not in any limitative sense.

A particularly effective composition includes an extinguishant base having the following ingredients.

Sesquiterpene: 40%
Solvent: 3%
Essential Oil: 30%
Dispersing Agent 10%
Homogenol 14: 17%.

What I claim is:

1. A fire fighting composition consisting essentially of about 86% to about 99% by weight of at least one halocarbon selected from the group consisting of: trichlorofluoromethane, dichlorodifluoromethane, trichlorotrifluoroethane, dichlorotetrafluoroethane; and between about 1% and 14% of an extinguishant base, said extinguishant base consisting essentially of a sesquiterpene and one or more essential oils.

2. A composition as claimed in claim 1, wherein said extinguishant base comprises about 7.5% to about 14% of the composition.

3. A composition as claimed in claim 1, wherein said extinguishant base comprises about 9% to about 10% of the composition.

4. A method of firefighting including the step of applying an effective quantity of a composition as claimed in claim 1 to the fire.

5. A method as claimed in claim 4, wherein the composition is mixed with water applied to the fire.

* * * * *